US006339857B1

(12) United States Patent
Clayton

(10) Patent No.: US 6,339,857 B1
(45) Date of Patent: Jan. 22, 2002

(54) SPRING ARRANGEMENT FOR MATTRESSES

(75) Inventor: Barry Clayton, Rossendale (GB)

(73) Assignee: Siddall and Hilton Limited of Central United Kingdom

( * ) Notice: Subject to any disclaimer, the term of this patent is extended or adjusted under 35 U.S.C. 154(b) by 0 days.

(21) Appl. No.: 09/537,838

(22) Filed: Mar. 29, 2000

(30) Foreign Application Priority Data

Mar. 30, 1999 (GB) ..... 9907183

(51) Int. Cl.[7] ..... A47C 27/07
(52) U.S. Cl. ..... 5/716; 5/655.7; 5/727
(58) Field of Search ..... 5/716, 721, 655.7, 5/727, 248, 256, 253; 267/91, 92, 93, 101

(56) References Cited

U.S. PATENT DOCUMENTS

| | | | |
|---|---|---|---|
| 3,911,511 | A | 10/1975 | Higgins et al. |
| 4,112,528 | A | 9/1978 | Higgins |
| 5,509,642 | A | 4/1996 | Wells |

FOREIGN PATENT DOCUMENTS

| | | | |
|---|---|---|---|
| CH | 374159 | | 2/1964 |
| EP | 0 053 739 | A1 | 6/1982 |
| EP | 0 053 739 | B1 | 6/1982 |
| EP | 0 082 259 | A1 | 6/1983 |
| EP | 0 082 259 | B1 | 6/1983 |
| GB | 725483 | | 3/1955 |
| GB | 745241 | | 2/1956 |
| GB | 869563 | | 5/1961 |
| GB | 1034315 | | 6/1966 |
| GB | 1 556 910 | | 11/1979 |
| GB | 2 215 199 | A | 9/1999 |
| GB | 2 339 147 | A | 1/2000 |
| WO | WO98/41127 | | 9/1998 |

*Primary Examiner*—Lynne H. Browne
*Assistant Examiner*—Fredrick Conley
(74) *Attorney, Agent, or Firm*—Robert D. Varitz, PC

(57) ABSTRACT

A spring arrangement in which the springs are coil springs and are disposed in adjacent rows with the coil springs in each row being spaced apart along the length or across the width of the arrangement, and wherein interconnecting or lacing wires interconnect the springs in a row and also the springs in the adjacent row to form rows of spaced interconnecting springs and with the coils of adjacent similar rows being juxtaposed, characterised in that the spacing apart of the coil springs in the rows is not constant/equal and some of the springs in each of the rows are more closely spaced together where greater support or firmer support is required.

17 Claims, 5 Drawing Sheets

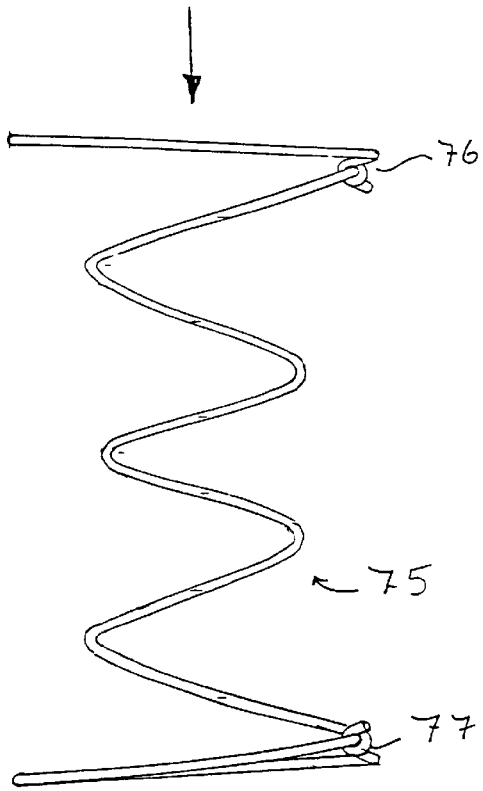
FIG. 4
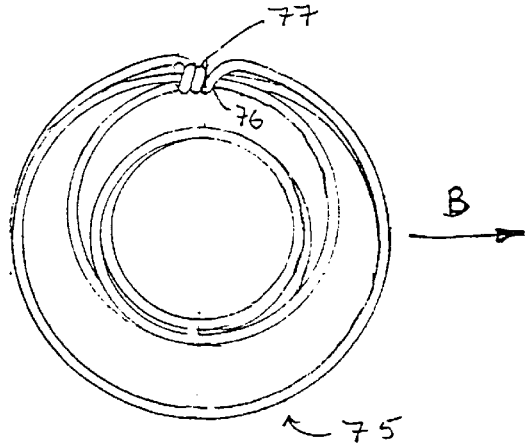
FIG. 5
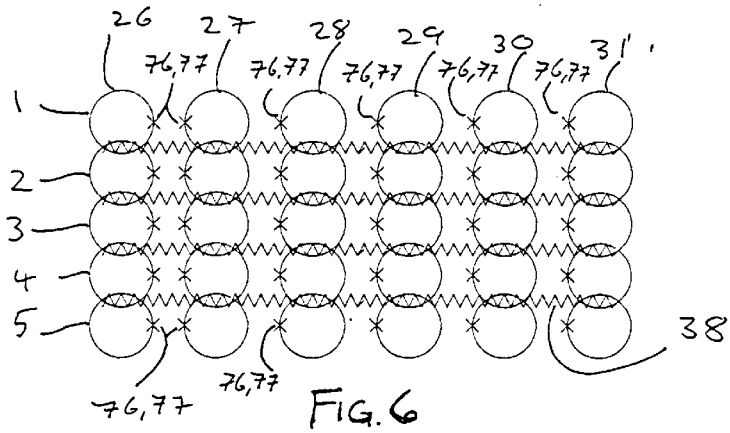
FIG. 6
FIG. 7
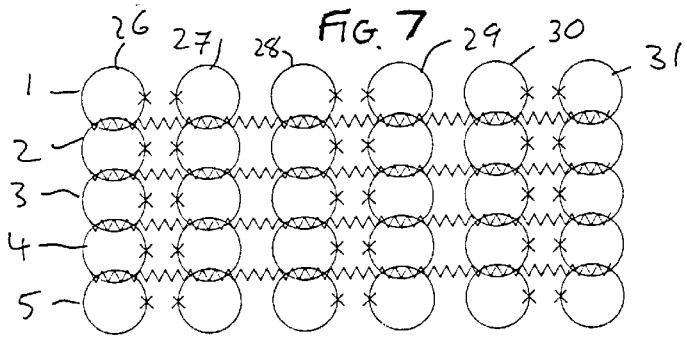

SPRING ARRANGEMENT FOR MATTRESSES

FIELD OF THE INVENTION

The present invention relates to an improved spring arrangement for mattresses and to mattresses when incorporating such.

BACKGROUND OF THE INVENTION

In a "conventional" arrangement of springs (FIG. 1) for mattresses, the coil springs are arranged in transverse rows of spaced apart coils and the spaced springs in one row and the next adjacent row of similarly spaced coils are interconnected by a helical "lacing" wire which runs across the width of the mattress for pairs of coils. The arrangement results in the coils being spaced apart across the width of the mattress or other article.

It is also known in such conventional constructions for a "zoning" effect to be achieved wherein it is arranged that the diameter of the wire differs in different rows in different regions so as to thereby produce a harder sprung region in the middle of the mattress which is to receive the greater load with softer springing at the head and foot to achieve the desired effect but this construction disadvantageously requires additional wire and forming operations etc.

It is also known (FIG. 2) to arrange coil springs in rows of regularly spaced apart coils along the length of a mattress and the coils of a row (and of one adjacent row) are interconnected by a helical lacing wire in rows which runs from "head-to-toe" i.e. along the normal length of the mattress with the result that the coil springs are regularly spaced apart along the length of the mattress and interconnected by the helical lacing wire.

Coil springs are "handed" i.e. left or right handed, in the same sense as a screw thread is left or right handed, and depending on the direction of coiling of the springs and such "handing" affects the way the springs compress and their tendency to lean over to one side. Coil springs are normally helically wound and often have a double conical winding.

Coil springs are produced from wire and the opposite otherwise free ends of the wire are secured by being bent around opposite ends of the coil to form so called "knots" and such knots are on the same side of the coils (and indicated by a cross herein).

The most commonly used knotted springs are known as Bonnell springs (FIGS. 4 & 5), and such are made of right-hand helixes, for example, and similarly disposed with their knots being in the same orientation with the result that there is a tendency when being compressed along the axis of the spring (force in direction A), for the spring to fall away in one direction and to one side (arrow B) which is substantially at 90° to the diametral plane intersecting the two knots. It is known in the conventional arrangement for all the coils to have their knots disposed in the same manner (FIG. 6) (apart from the outermost ones of each row which are reversed to avoid the sharp knot end projecting outwardly which might otherwise be a hazard to users).

SUMMARY OF THE INVENTION

According the present invention there is provided a spring arrangement for a mattress in which the springs are double conical springs with each coil spring being knotted at its opposite ends on one side or is unknotted at its opposite ends on one side and has a tendency when subject to load to bend over at another side, and wherein a plurality of rows of said spaced apart springs are provided in a head-to-toe arrangement in which the springs are disposed in adjacent rows with the coil springs in each row being spaced apart along the length of the arrangement, and wherein interconnecting or lacing wires interconnect along the length of the arrangement, the springs in a row and also the springs in the adjacent row to form rows of spaced interconnecting springs and with the coils of adjacent similar rows being juxtaposed, and in which the spacing of the springs in each of the head-to-toe rows is closer in at least one and the same region where greater support or firmer support is required, and in which either a plurality of pairs of the springs in each row of interconnected spaced apart springs are arranged so that the knotted or said unknotted sides in each pair of springs are juxtaposed or so that said one sides to which there is a tendency to bend over are oppositely disposed in said pairs or otherwise oriented to act to counteract each other, or in which the orientation of all or at least a group of springs in one row is opposite to the orientation of all or at least a group of the springs in the next or an adjacent row so as to provide rows of springs with directional counteracting tendencies to bending over in a single direction.

It is an object of the present invention to provide an improved spring arrangement and a mattress incorporating such an arrangement so as to provide more support in one or more regions, as desired, and, also to create a reduced tendency of the upper portions of the springs to move laterally in the same direction because of the creation of a greater stability of the overall arrangement and thus an improved performance.

The arrangement of the invention enables a firmer support to be provided in one or more regions as desired and whilst at least the central region of a mattress will be normally arranged to be firmer, additional or alternative regions are envisaged. Furthermore the arrangement reduces or minimises the tendency of the upper regions springs to all lean or flex to move in the same lateral direction and the spring arrangement incorporating provides improved performance. It is envisaged other orientation of the spring knotting is possible to achieve improved performance.

BRIEF DESCRIPTION OF THE DRAWINGS

The invention will be described further, by way of example, with reference to the accompanying drawings, in which:

FIG. 4 is a schematic elevation of a double helically coiled right-hand spring illustrating the knotted ends thereof and arrow A to force compressing such;

FIG. 5 is a schematic plan of the spring of FIG. 4 with arrow B indicating the direction or one side to which the spring has a tendency to collapse;

FIG. 6 is a schematic plan of a part of a conventional spring arrangement with the crosses representing the knots of the springs and all being in the same disposition/ orientation apart from the springs at the ends of a row which are reversed solely to avoid the knot ends projecting dangerously outwardly;

Figure 2:
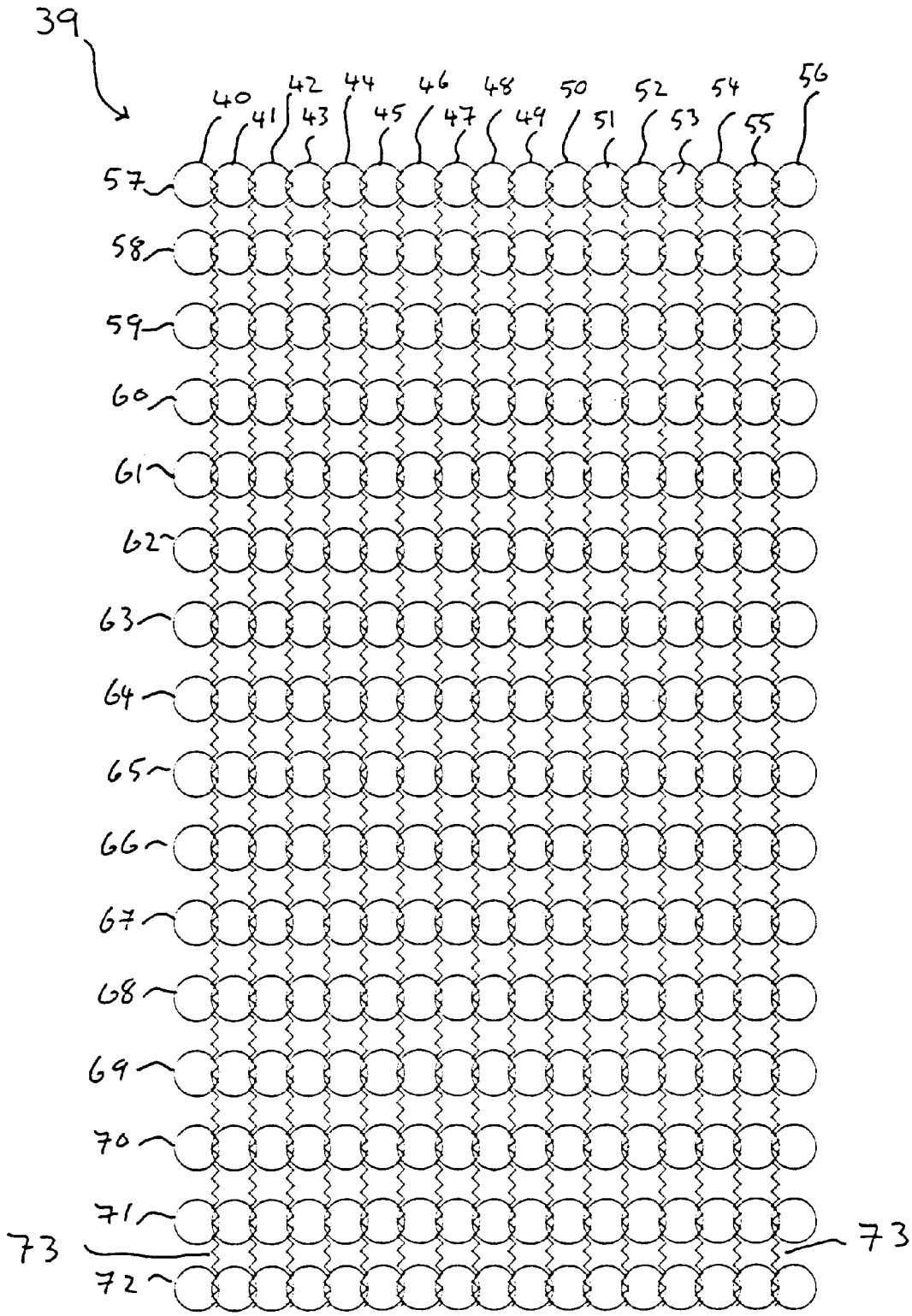
FIG. 2 is a schematic plan view of a "head-to-toe" spring arrangement with the rows of spaced apart springs extending along the length.
Figure 8:
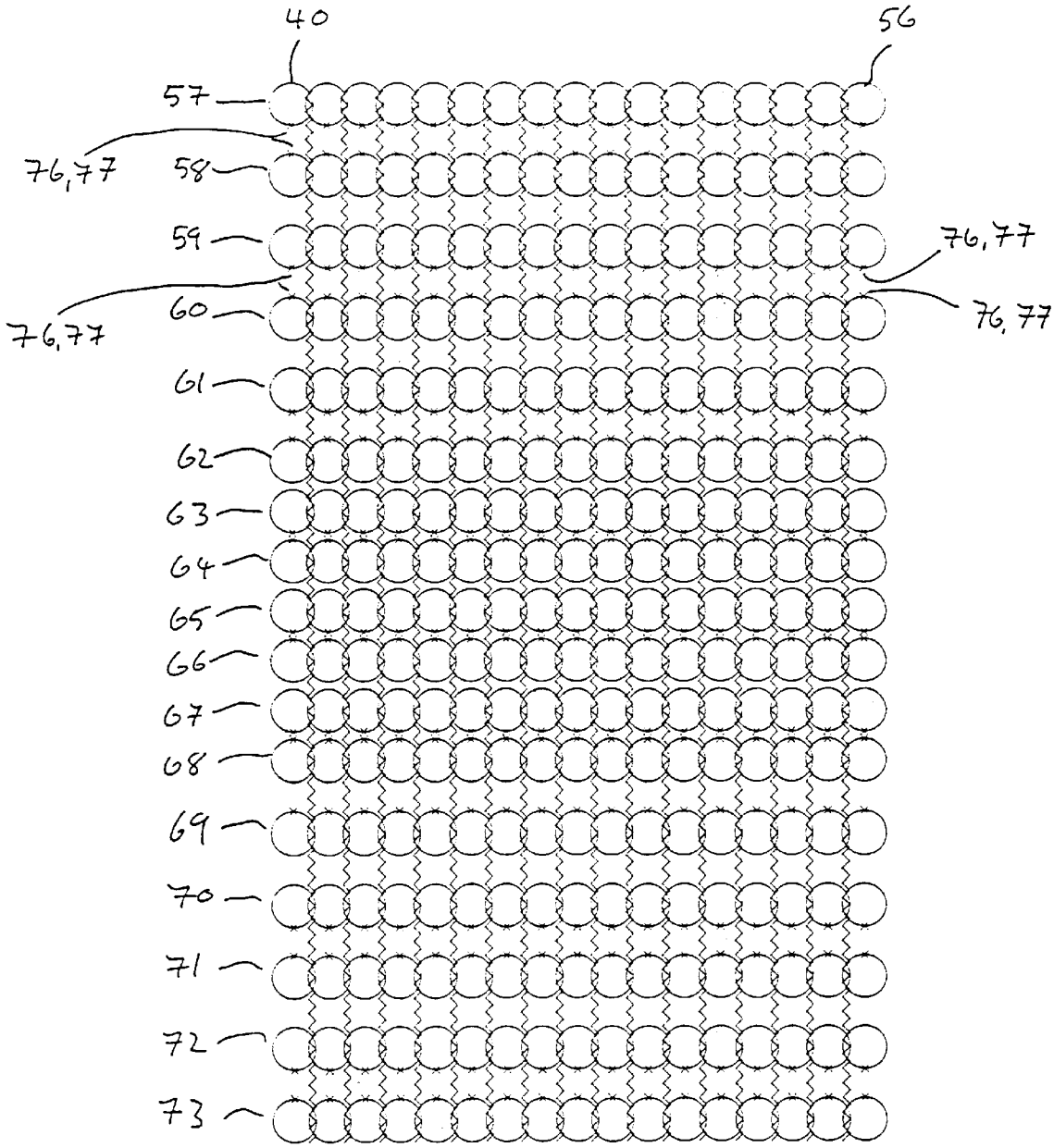

FIG. 7 is a schematic plan elevation of a disposition of the knots of the springs in a conventional arrangement wherein the knots of adjacent pairs of springs on a row are juxtaposed or face each other to produce a more stable overall support;

FIG. 8 is a schematic plan elevation of a part of a head-to-toe arrangement similar to FIG. 2 (or 3) according to the present invention and wherein the knots of the adjacent pairs of spaced springs face each other.

DETAILED DESCRIPTION OF THE PREFERRED EMBODIMENTS

Figure 1:
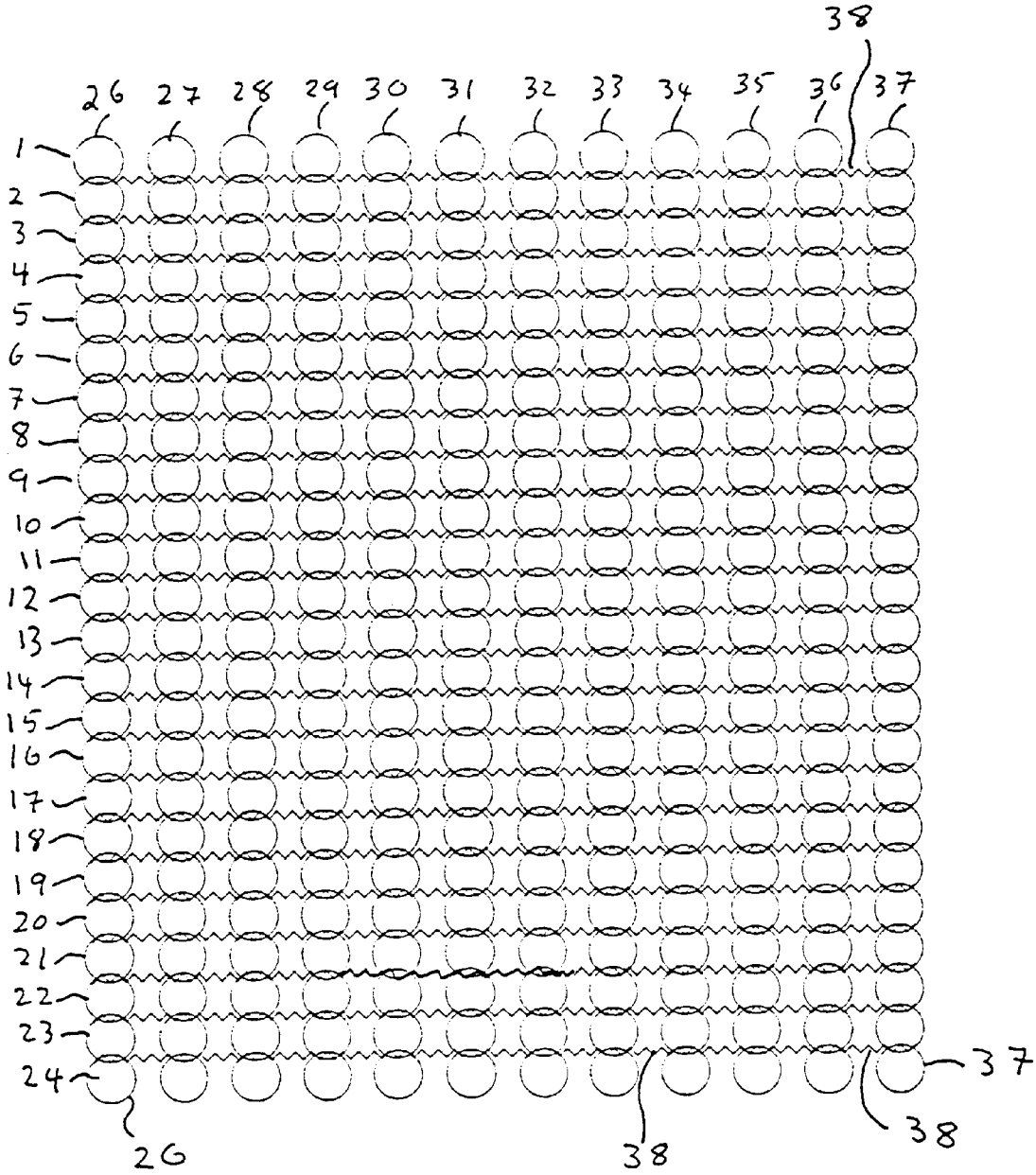
FIG. 1 is a schematic plan elevation of a portion of a spring arrangement forming a "conventional arrangement" with the rows of spaced apart springs extending across the width.

A part of a conventional arrangement of springs for a mattress is illustrated in FIG. 1 wherein there are, for example, included twelve horizontal rows 1 to 25 of spaced helically coiled springs 26 to 37 for forming part of a mattress with each horizontal row 1 to 25 comprising spaced apart double conical springs 26 to 37 interconnected at opposite ends by helical lacing wires 38 and with the adjacent row being interconnected by the same upper and lower wires 38 so as to produce interconnected horizontal rows 1 to 25 of interconnected spaced apart springs 26 to 37. In such arrangement, it is known to have the spring wire in the central region, for example, of greater diameter to thereby increase the firmness of the support provided by the springs in such region—a so called "zoned unit".

In FIG. 2 part of a known "head-to-toe" mattress arrangement 39 of helical coil springs is illustrated wherein there are illustrated a plurality of vertically disposed rows 40 to 56 of spaced apart helical springs 57–72 are illustrated with the sixteen helical coils of a row each being interconnected by an upper lacing wire and a lower lacing wire 73 (only one illustrated) and to the next row.

Figure 3:
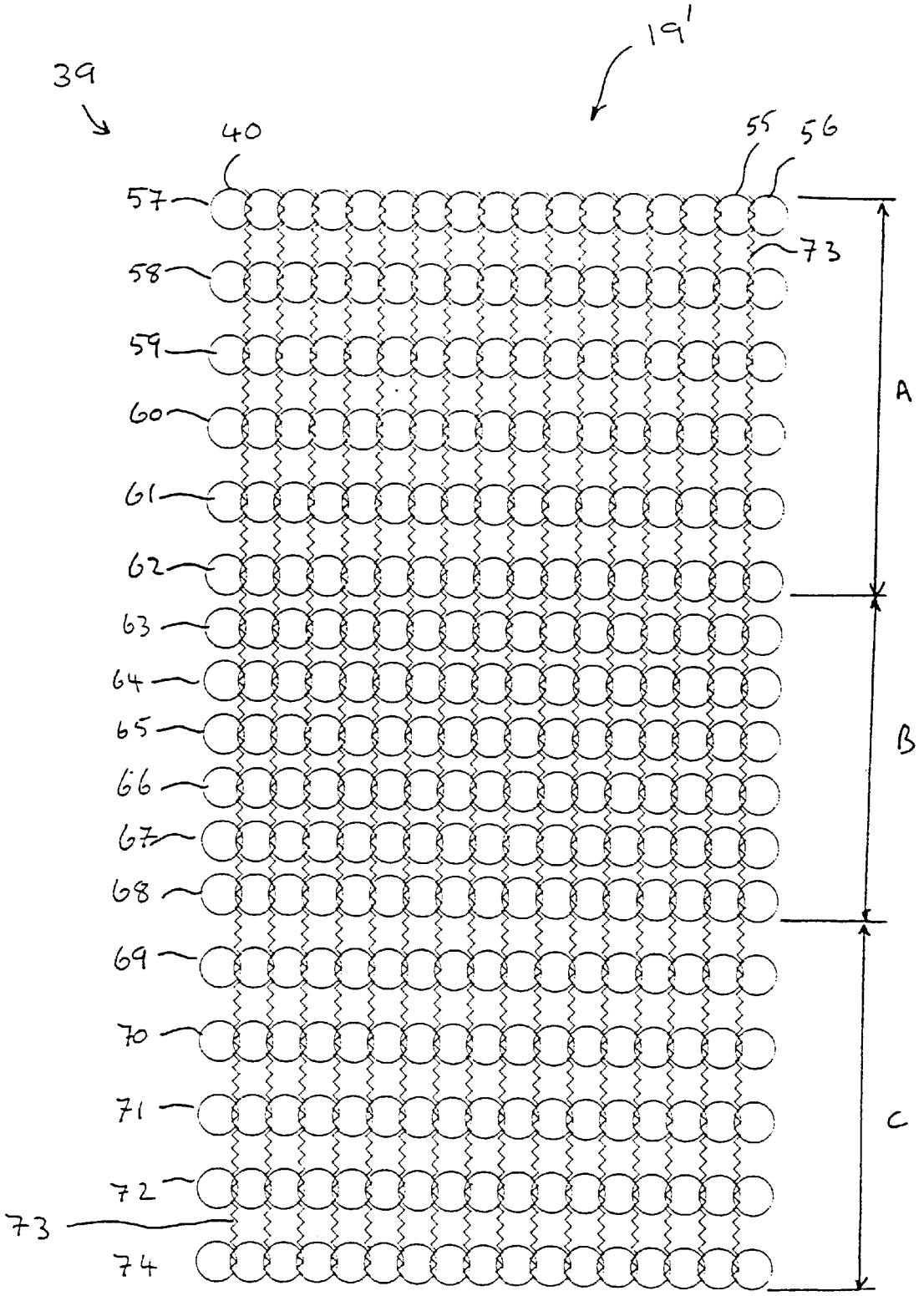
FIG. 3 is a fragmentary schematic illustration of a head-to-toe arrangement where the spacing between some of the coil springs or rows is reduced in the central zone i.e. the springs of each row are more closely located together.

FIG. 3 illustrates an arrangement wherein in a head-to-toe arrangement similar to that of FIG. 2, but in the central region the spacing of the coils 62–68 in each row 40–55 is reduced so as to provide a firmer support in the central region B which is subject to greater load than head and toe regions A and C. As a result of the closer central spacing, the spacing in the head and toe regions A and C may be greater than hitherto. Any other suitable disposition or spacing arrangement of rows is possible as may be desired within the scope of the invention.

FIG. 4 is a schematic elevation of a known double helix coil 75 spring of right-hand wherein the ends of the wire from which are all disposed on the same side as the coil is formed are bent around the ends of the coil and secured there as "knots" 76,77 and in known arrangement.

FIG. 5 is schematic plan of the springs of FIG. 4 indicating by arrow B (at right angles to the diametral plane 75' through the knots 76,77) the direction the spring has a tendency to bendover or lean when an axial load is applied in the direction of arrow A;

FIG. 6 is a fragmentary schematic plan detail of a conventional spring arrangement similar to that in FIG. 1 wherein the upper and lower spring knots 76,77 in each row 1–25 are on the same side and are represented by a cross 76,77 and all the coil springs 27–31 (37) are similarly orientated with no knots 76,77 in a horizontal row 1–25 being adjacent except that only outer springs 26 on one side are arranged with their knots away from the outer edge i.e. to avoid such causing damage to the mattress casing or to a user. In other words, the outer springs of a row which would otherwise have their knots 76,77 outwards, are reversed.

FIG. 7 is a fragmentary schematic detail similar to FIG. 6 wherein adjacent pairs of springs 26,27 and 28,29 and 30,31 etc., in horizontal rows 1–25 as viewed are oriented so that the spring knots 76,77 are adjacent to provide a more stable arrangement and better performance.

FIG. 8 is a fragmentary schematic detail of a head-to-toe arrangement of coil springs similar to FIG. 3 and according to the present invention wherein adjacent pairs of coil springs 57,58 and 59,60 and 61,62 etc., of a vertical row 40–56 as viewed, are oriented so that the spring knots 76,77 of adjacent rows of springs are adjacent to provide a more stable arrangement and better performance.

Instead of knots 76,77 of adjacent pairs of springs in a row in FIGS. 7 or 8 facing each other, in one row e.g. 26 or 40 they may all be of the same orientation (e.g. as in a row of FIG. 6) whilst in the next row they may all be reorientated through 180° so as to have the reverse effect to compensate the adjacent row etc. alternating throughout the structure. Alternatively, groups of rows may be oppositely oriented or other combinations.

For information, the invention is concerned, by way of example, with springs with four turns of 8.9 cm to 10.78 cm (3½" to 4¼") tall, or five turns of 12.7 cm to 14.61 cm (5" to 5¾") tall or of six turns of 15.24 cm (6") or more tall.

Whilst reference has been made in the specific description to knotted springs, it is equally applicable to unknotted springs which exhibit the same tendency to lean or bend in one direction when loaded and such will be arranged in the same manner i.e. so that the spring orientations are alternately or otherwise arranged other than all in the same disposition.

Known "head-to-toe" arrangements were provided so as to reduce the tendency of two occupants rolling inwardly together. The provision of more closely spaced springs in the central region to provide increased support, as disclosed in GB 2215199 of Airsprung, has the disadvantage of having a considerably greater tendency to lean to one side i.e. such has a tendency to be unstable. The features of the present invention illustrated in FIG. 8 of the juxtaposition of the springs in the rows with the knots adjacent etc., greatly enhances the stability of the structure whilst at the same time increases the resistance to compression i.e. it unexpectedly additionally increases the stiffness both lengthwise and widthwise, than hitherto would have been provided by a similar structure only possessing some of the claimed features.

The invention is further defined by reference to the following claims, the subject matter of which is incorporated herein by reference.

I claim:

1. A spring arrangement for a mattress comprising:

an array of springs, wherein the springs are double conical springs (75) with each coil spring (75) being knotted (76, 77) at its opposite ends on one side or is unknotted at its opposite ends on one side and has a tendency when subject to load to bend over at another side (B), and wherein a plurality of rows of said springs (75) are provided spaced apart in a head-to-toe arrangement (39) in which the springs (75) are disposed in adjacent rows (40–56) with the coil springs (57–72 and 74) in each row (40–56) being spaced apart along the length of the arrangement (39), and wherein interconnecting or lacing wires (73) interconnect the springs in a row (even number reference numerals) along the length of the arrangement, and also interconnect the springs in the adjacent row (odd numbered reference numerals) to form rows (40–56) of interconnected spaced springs and with the coils of the adjacent similar rows (odd and even numbers) being juxtaposed, and in which the spacing of the springs (57–72 and 74) in each of the head-to-toe rows (40–56) is closer in at least a central region (B) where greater support or firmer support is required, and in which a plurality of pairs (57, 58, 59, 60 etc.) of the springs in each row (40–56) of interconnected spaced apart springs are arranged so that the knotted (76, 77) or said unknotted sides in each said plurality of pairs of springs (57, 58; 59, 60 etc.) are juxtaposed or so that said one sides to which there is a tendency to bend over are oppositely disposed in said pairs or otherwise oriented to act to counteract each other.

2. The spring arrangement of claim 1, in which the springs in the central region (B) are equally spaced in each row and are more closely spaced than the remaining springs.

3. The spring arrangement of claim 2, in which the at least one said group of springs is in a central region of the head-to-toe arrangement.

4. The spring arrangement of claim 1, wherein at least one group of springs or all springs in at least one row are arranged in pairs with like pairs juxtaposed such that said one side of a pair are oppositely disposed and act in opposite directions to reduce the tendency of the pairs of springs to bend over in one direction.

5. The spring arrangement of claim 4, in which all the pairs of springs or all the pairs of springs other than those in an outer lateral row as would otherwise present outward projections are arranged with like parts juxtaposed.

6. The spring arrangement of claim 5, in which the springs are knotted coil springs and the knots in said like parts are juxtaposed.

7. The spring arrangement of claim 1, in which the springs are arranged such that the knots or equivalent portions of an unknotted spring of adjacent pairs of spaced springs in a row face each other or are juxtaposed or the springs are arranged such that the spaced springs in one row have the knots all in the same orientation whilst all the spaced springs in the next or an adjacent row have the knots in the opposite orientation, ie., reorientatd through 180°.

8. The spring arrangement of claim 1 wherein the spring arrangement is enclosed in a mattress.

9. A spring arrangement for a mattress in which the springs are double conical springs with each coil spring being knotted at its opposite ends on one side or is unknotted at its opposite ends on one side, and has a tendency when subject to load to bend over at another side, and wherein a plurality of rows of said springs are provided spaced apart in a head-to-toe arrangement in which the springs are disposed in adjacent rows with the coil springs in each row being spaced apart along the length of the arrangement, and wherein interconnecting or lacing wires interconnect the springs in a row along the length of the arrangement, and also interconnect the springs in the adjacent row to form rows of interconnected spaced springs and with the coils of the adjacent similar rows being juxtaposed, and in which the spacing of the springs in each of the head-to-toe rows is closer in at least a central region where greater support or firmer support is required, and in which the orientation of all or at least a group of springs in one row is opposite to the orientation of all or at least a group of the springs respectively in the next or an adjacent row so as to provide rows of springs with directional counteracting tendencies to bending over in a single direction.

10. The spring arrangement of claim 9, in which the springs in the central region in each row are more closely spaced and the remaining springs are equally spaced.

11. The spring arrangement of claim 10, in which at least one said group of springs is provided and is in a central region of the head-to-toe arrangement.

12. The spring arrangement of claim 9, wherein at least a group of springs or all springs in at least one row are arranged in pairs with like pairs juxtaposed such that said one side of a pair are oppositely disposed and act in opposite directions to reduce the tendency of the pairs of springs to bend over in one direction.

13. The spring arrangement of claim 12, in which all the pairs of springs or all the pairs of springs other than those in an outer lateral row as would otherwise present outward projections are arranged with like parts juxtaposed.

14. The spring arrangement of claim 12, in which the springs are knotted coil springs and the knots in said like parts are juxtaposed.

15. The spring arrangement of claim 9, in which the springs are arranged such that the spaced springs in one row have the knots all in the same orientation whilst all the spaced springs in the next or an adjacent row have the knots in the opposite orientation, i.e., reorientated through 180°.

16. A spring arrangement for a mattress in which the springs are double conical springs with each coil spring being knotted at its opposite ends on one side, and has a tendency when subject to load to bend over at another side, and wherein a plurality of rows of said springs are provided spaced apart in a head-to-toe arrangement in which the springs are disposed in adjacent rows with the coil springs in each row being spaced apart along the length of the arrangement, and wherein interconnecting or lacing wires interconnect the springs in a row along the length of the arrangement, and also interconnect the springs in the adjacent row to form rows of interconnected spaced springs and with the coils of the adjacent similar rows being juxtaposed, and in which the spacing of the springs in each of the head-to-toe rows is closer in at least a central region where greater support or firmer support is required, and in which a plurality of the springs in each row of interconnected spaced apart springs are arranged so that the knotted sides are similarly disposed and which the orientation of the knotted sides of all or at least a group of springs in one row is opposite to the orientation of the knotted sides of all or at least a group of the springs in the next or an adjacent row so as to provide rows of springs with directional counteracting tendencies to bending over in a single direction.

17. The arrangement of claim 16, in which the springs are arranged such that the spaced springs in one row have the knots all in the same orientation whilst all the spaced springs in the next or an adjacent row have the knots in the opposite orientation, i.e., reorientated through 180°.

* * * * *